US007246687B2

(12) United States Patent
Martinelli

(10) Patent No.: US 7,246,687 B2
(45) Date of Patent: Jul. 24, 2007

(54) ELEVATOR CAR WITH ECCENTRIC LOAD COMPENSATION SYSTEM

(75) Inventor: Roger Martinelli, Rotkreuz (CH)

(73) Assignee: Inventio AG, Hergiswil NW (CH)

( * ) Notice: Subject to any disclaimer, the term of this patent is extended or adjusted under 35 U.S.C. 154(b) by 370 days.

(21) Appl. No.: 10/745,071

(22) Filed: Dec. 22, 2003

(65) Prior Publication Data

US 2004/0134716 A1 Jul. 15, 2004

(30) Foreign Application Priority Data

Dec. 24, 2002 (EP) ..... 02406145

(51) Int. Cl.
*B66B 1/34* (2006.01)

(52) U.S. Cl. ..... 187/292; 187/391

(58) Field of Classification Search ..... 187/224, 187/228, 275, 281, 285, 291, 305, 348, 361, 187/404, 405, 414, 391
See application file for complete search history.

(56) References Cited

U.S. PATENT DOCUMENTS 3,845,842 A * 11/1974 Johnson ..... 187/266

FOREIGN PATENT DOCUMENTS

| | | |
|---|---|---|
| JP | 07 215635 | 8/1995 |
| JP | 08 067465 | 3/1996 |
| JP | 08 143234 | 6/1996 |

* cited by examiner

*Primary Examiner*—Jonathan Salata
(74) *Attorney, Agent, or Firm*—Fraser Clemens; Martin & Miller LLC; William J. Clemens

(57) ABSTRACT

A weight compensation system and a method of operating the system for compensating eccentric loading of an elevator car vertically movable in an elevator shaft. The elevator car has spring-mounted rollers engaging guide rails and the system includes sensors detecting a position of the elevator car relative to the guide rails. A control unit is connected to the sensors and a hydraulic compensating system for controlling movement of liquid to compensate for the eccentric loading of the elevator car.

20 Claims, 10 Drawing Sheets

500
52
51
56
53
54
55
50
57
58
6
7
8

ELEVATOR CAR WITH ECCENTRIC LOAD COMPENSATION SYSTEM

BACKGROUND OF THE INVENTION

The present invention relates to an elevator car with a compensating system for weight compensation in the case of eccentric loading and to a method for weight compensation of an elevator car.

Elevator installations usually comprise an elevator shaft in which guide rails for guidance of an elevator car are mounted or provided. The car is equipped with rollers which roll along the guide rails. In order to increase travel comfort, to compensate for unevennesses of the guide rails and to be able to more smoothly guide an eccentrically loaded elevator car, the rollers are resiliently suspended. The springs used, particularly in the case of high-performance elevators, typically have a progressive spring characteristic which is so designed that in the case of small spring strokes the springs produce a soft springing of the elevator car. In the case of larger spring strokes, the springs work in the hard range of the characteristic in order to be able intercept higher forces.

If an elevator car with spring-mounted rollers is now loaded eccentrically then a part of the springs operate in the hard range, which can lead to losses in comfort.

An elevator installation is known which provides a system for mechanical displacing of a compensating weight in order to counteract an eccentric loading. Such an elevator installation is shown in the Japanese patent application which is published under the number JP 08067465-A2. The compensating weight is arranged underneath the base of the elevator car and can be displaced. A load detector is provided which detects a non-uniform loading and ascertains a suitable position for the compensating weight. The compensating weight is then displaced into this position. A system of that kind is slow and depending on the respective form of embodiment causes noises during displacement of the compensating weight, which noises can be perceived as disturbing.

SUMMARY OF THE INVENTION

The present invention concerns an elevator car for vertical movement in an elevator shaft which has vertically arranged guide rails, wherein the elevator car has spring-mounted rollers for guiding the elevator car along the guide rails. A weight compensation means is attached to the elevator car and includes a hydraulic compensating system displacing a quantity of a liquid in response to an eccentric loading of the elevator car. The compensating system includes a sensor system for detecting the eccentric loading wherein the sensor system has at least two position sensors for establishing a position of the elevator car with respect to the guide rails.

The present invention also concerns a method of weight compensation of an elevator car in case of eccentric loading comprising the steps of: a) detecting eccentric loading of the elevator car by determining a position of the elevator car relative to guide rails with a sensor system; b) actuating a hydraulic compensating system attached to the elevator car to provide weight compensation in response to the detected eccentric loading; and c) monitoring the weight compensation with the sensor system. The method can further include a step of calculating a required liquid displacement in a control unit before or during performing the step b).

It is an object of the present invention to provide an elevator car which can be guided along guide rails with low guide forces even in the case of eccentric loading.

It is an object of the present invention to provide an elevator car which satisfies high comfort demands even in the case of eccentric loading.

It is a further object of the present invention to provide a method for weight compensation in the case of eccentric loading of an elevator car.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1B:
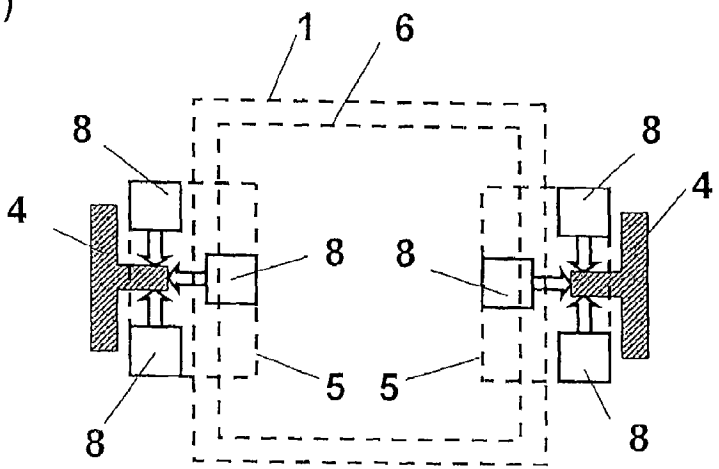
FIGS. 1*a* and 1*b* are schematic front elevation and top plan view respectively of an elevator installation with a hydraulic compensating system for weight balancing of a elevator car, according to the present invention.
Figure 1A:
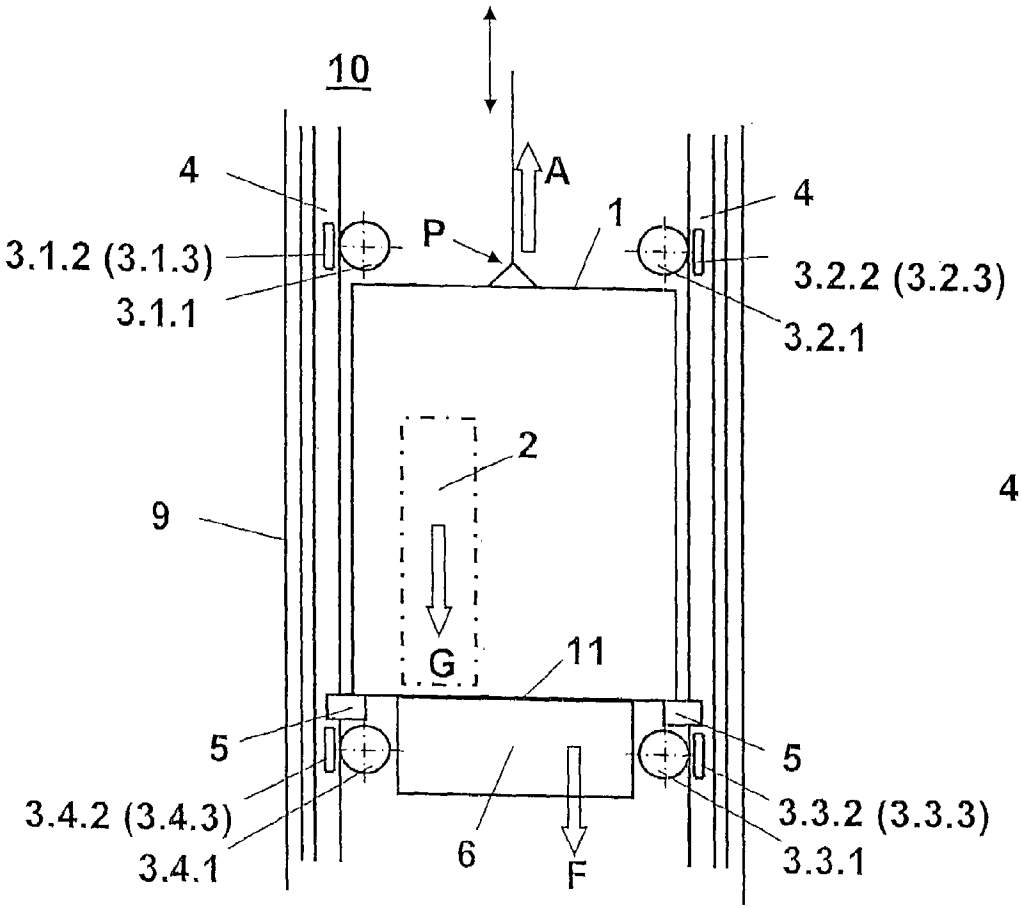

FIG. 1*a* shows a view of an elevator installation 10 according to the present invention. The elevator installation 10 comprises an elevator car 1 for vertical movement in an elevator shaft 9, which shaft has vertically arranged guide rails 4. The elevator car 1 further comprises spring-mounted rollers 3.1.1 to 3.4.3 in order to guide the elevator car 1 along the guide rails 4. In that case the spring-mounted rollers 3.1.1 to 3.4.3 can be designed in such a manner that a non-linear spring force is exerted on the rollers. In the case of small deflections or compressions of the spring—depending on the respective installation position—the spring operates in a soft range of the non-linearly extending spring characteristic. If the spring is further deflected or compressed, a range of the non-linearly extending spring characteristic which was designed to be harder comes into use. Springs with non-linearly extending spring characteristics can be advantageous for stabilization or for spring-cushioning of the elevator car 1 with respect to the guide rails 4, wherein the springs in the case of small roller loads operate in the soft range and gently cushion impacts. Higher roller loads have the consequence that the springs are strongly deflected or compressed. In this range the spring characteristics are steeper, i.e. the increase in spring force in the case of a defined increase in spring deflection is greater than in the linear range. In the case of an eccentric loading 2 of the elevator car 1 by a weight G, in that case a part of the springs acting on the rollers 3.1.1 to 3.4.3 can operate in the range of the spring characteristic designed to be harder, whereby the cushioning comfort of the elevator car is reduced.

For the weight compensation of the elevator car 1 the elevator installation 10 according to the invention comprises a hydraulic compensating system 6, which system can be fastened to the elevator car 1. Advantageously, the compensating system 6 can be fastened under a floor 11 of the elevator car 1, as shown in FIG. 1*a*. Through a displacement of a liquid within the hydraulic compensating system 6 there is achieved in that case a compensation for a torque which acts on the elevator car 1 and which is caused by the weight G, which is arranged to be horizontally offset with respect to a point P of suspension of the elevator car 1.

This is schematically shown in FIG. 1*a*, where the weight G arranged offset relative to the central car suspension causes, in conjunction with the suspension force A, a torque acting on the elevator car 1 in counter-clockwise sense. In the case of such an eccentric loading the springs of the spring-mounted rollers 3.1.1 and 3.3.1 are strongly compressed and thereby act in the hard range of the spring characteristic. The springs of the spring-mounted rollers 3.2.1 and 3.4.1 thereagainst are less compressed in the case of such an eccentric loading. Through an appropriate liquid displacement it is achieved that a weight F of the liquid together with the suspension force A causes a torque which acts in opposite direction (in clockwise sense) and the elevator car 1 is thereby brought into a counter-balanced position. With such a system, which acts in both horizontal axes, the springs of all spring-mounted rollers 3.1.1 to 3.4.3 can operate in the soft range of the spring characteristic curves, since the corresponding spring forces of the rollers 3.1.1 to 3.4.3 are uniformly distributed. This advantageously serves for an improvement in travel comfort as well as an extension of the service life of the spring-mounted rollers 3.1.1 to 3.4.3. The liquid can in that case be water with appropriate admixtures, oil or another suitable liquid.

The elevator car 1 further comprises a sensor system 5 which system serves for establishing the eccentric loading 2. In the sense of the present invention thus all relevant imbalance positions of the elevator car 1 can be detected. In that case the sensor system 5 preferably comprises several position sensors 8 which can establish the position of the elevator car 1 with respect to the guide rails 4. FIG. 1*b* shows as a plan view a possible arrangement of the position sensors 8. The guide rails 4 are there illustrated as a T-shaped profile member, wherein, however, other profile shapes are also possible. The sensor system 5 can in that case advantageously be integrated in an arrangement with one of the guide rollers 3.1.1 to 3.4.3 or be installed at the floor of the elevator car 1 as is shown in FIG. 1*a*.

In one advantageous form of embodiment merely two sensors are used, which are so placed that each of the two sensors monitors the displacement of two diagonally opposite guide rollers. A first sensor can be associated with, for example, the roller 3.1.1. This sensor then monitors the position of the elevator car with respect to its rotation about a notional axis perpendicular to the plane of the drawing. A second sensor can be associated with, for example, the roller 3.1.2. This sensor then monitors the position of the elevator car with respect to its rotation about a horizontal notional axis parallel to the plane of the drawing. In order to obtain more reliable measurement results relative to the position of the elevator car the positions of initial rollers can be detected and evaluated.

The position sensors 8 can be realized as analog elements, wherein, for example, spring forces which the elevator car 1 exerts in various directions on the guide rail 4 are measured. In another form of realization there can be measured, for example, distances which correspond with the spacing of the elevator car 1 from the guide rail 4 at different locations and in different directions.

In a further form of realization the position sensors 8 can be constructed as digital elements which can establish a mechanical contact with the guide rail 4. In that case the presence of one or more mechanical contacts with respect to different contact points of the guide rail 4 can signal an unbalanced position of the elevator car 1. Correspondingly, the absence of mechanical contacts can signal a balanced position of the elevator car 1. In the sense of the present invention also combinations of analog and digital position sensors 8, which are integrated in the sensor system 5, are possible.

Optical, inductive or magnetic sensors can also be used.

Figure 2A:
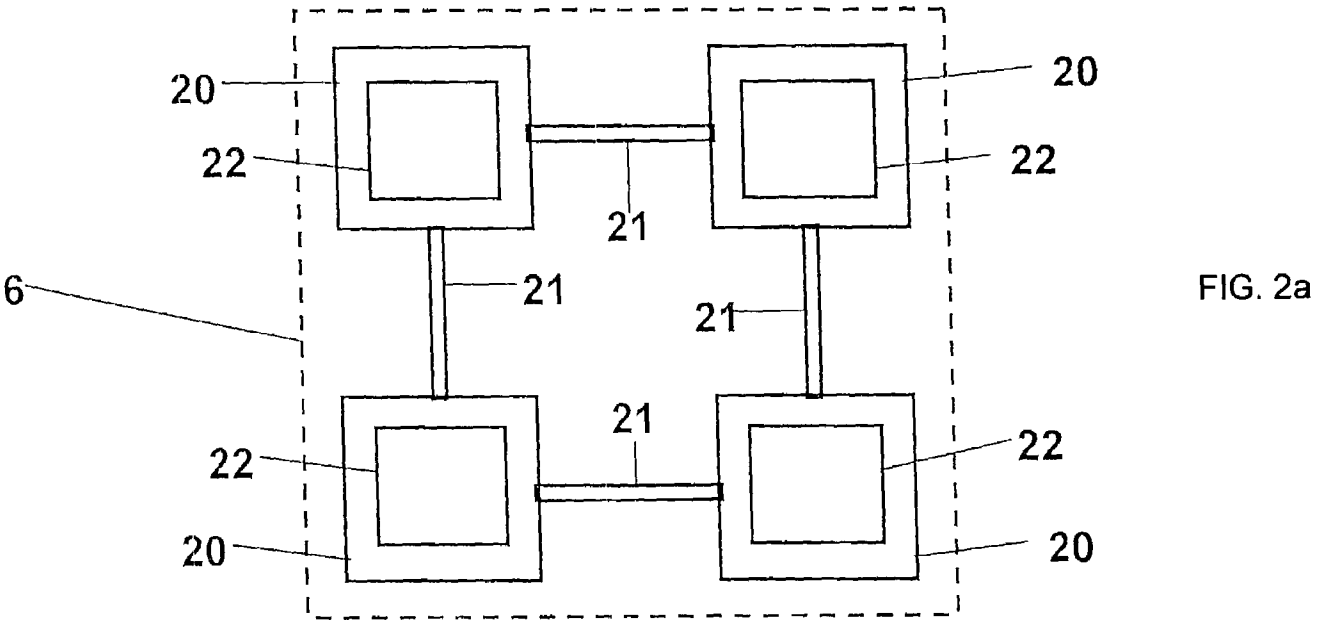
FIGS. 2*a* and 2*b* are schematic top plan view and front elevation in cross section respectively of the hydraulic compensating system according to a first embodiment of the present invention.
Figure 2B:
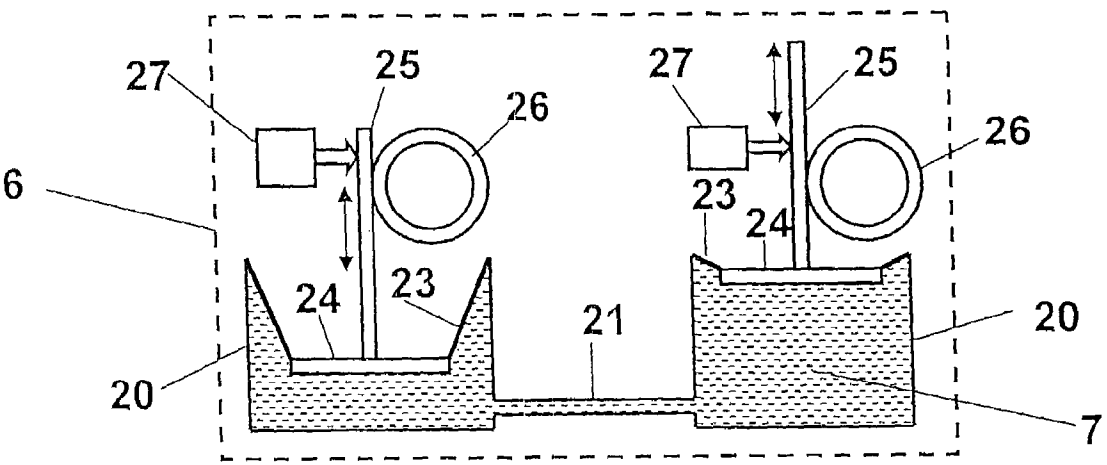

A first detailed form of embodiment according to the present invention is shown in FIGS. 2*a* and 2*b*. There the hydraulic compensating system 6 is so designed that a controlled displacing of the liquid 7 can be produced by a mechanical displacement. The compensating system 6 then comprises several containers 20 which contain the liquid 7. The containers 20 are interconnected by connecting ducts 21 in order to thereby enable a displacement of the liquid 7. The point of action of the resulting weight F of the liquid 7 is thereby displaced, whereby a counterbalancing of the elevator car 1 with the weight G of the eccentric loading 2 can be achieved. FIG. 2*a* shows a schematic plan view with four cube-shaped containers 20 as example. Advantageously, a container 20 can have a volume of approximately 150 liters to 200 liters. The containers 20 can in that case also be cylindrical or spherical or have another form. Equally, the number of containers 20 is not restricted to four. The connecting ducts 21 between the containers 20 can also be executed in an arrangement other than as shown in FIG. 2*a*. Advantageously, the arrangement of the containers 20 and the connecting ducts 21 is so designed that a largest possible physical displacement of the point of action of the resultant weight F is possible with the smallest possible overall volume. A hydraulic compensating system 6 with smallest possible dimensions and overall weight thereby results.

FIG. 2*b* shows a schematic view of the hydraulic compensating system 6 according to the first form of embodiment of the present invention. In that case the container 20 comprises a displacement system 22 for liquid displacement, wherein the displacement system 22 comprises a movable plunger 24 and a flexible diaphragm 23. The plunger 24 can be moved by way of a spindle 25, wherein the drive of the spindle 25 can be effected by way of a setting motor 26. The position of the spindle 25 can then be detected by a travel sensor 27. The quantity of the liquid 7 displaced in the container 20 can thereby be determined. The thus-described displacement system 22 can also be realized with the same effect in another manner, for example by a piston displacing in the container 20. It is clear to an expert that for realization of the hydraulic compensating system 6 still further parts, such as fastening elements, mechanical guide elements or ventilating devices are required, which are not shown in FIGS. 2*a* and 2*b*.

Figure 2C:
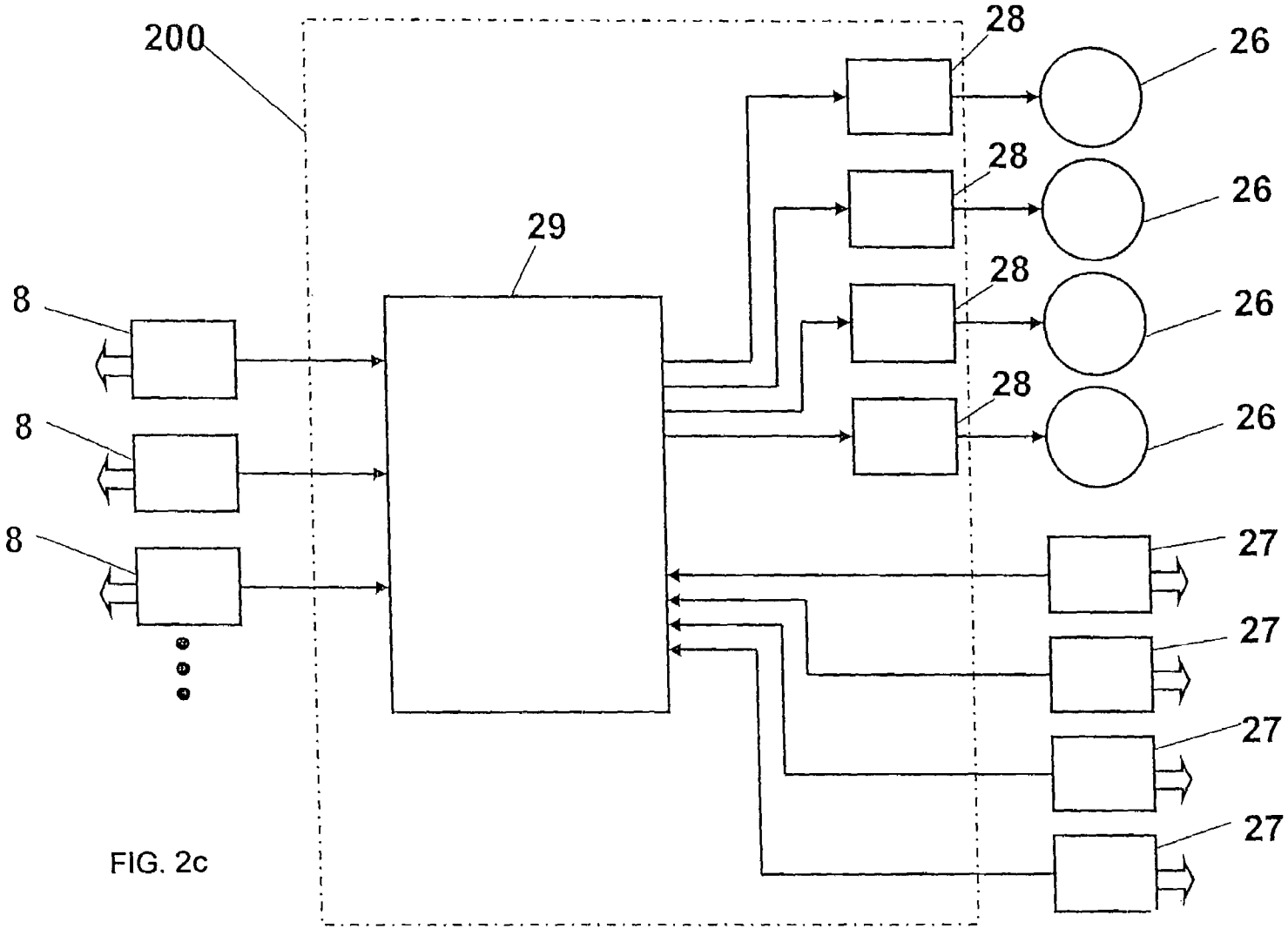
FIG. 2*c* is a schematic illustration of a control unit for control of the hydraulic compensating system shown in FIGS. 2*a* and 2*b* according to the first embodiment of the present invention.

FIG. 2*c* shows a schematic illustration of a control unit 200 for control of the liquid displacement of the hydraulic compensating system 6 according to the first form of embodiment of the present invention. The control system 200 comprises a computer unit 29 which is connectable with the position sensors 8. Moreover, the control unit 200 comprises several motor drive units 28 which are connectable with the computer 29, wherein each motor drive unit 28 is further connectable with a setting motor 26. The computer unit 29 is connectable with the travel sensors 27. The control unit 200 is in that case so designed that the position sensors 8 signal to the computer unit 29 the position of the compensating car 1, whereupon the computing unit 29 carries out a calculation of the requisite liquid displacement for weight balancing and whereupon as a result the appropriate setting motors 26 are actuated by way of the motor drive units 28. The travel sensors 27 signal to the computer unit 29 the position of the movable plunger and thereby enable determination of the instantaneous status of the liquid displacement. This process can be designed as a regulating circuit, wherein the position sensors 8 deliver a feedback of the instantaneous state of the weight balancing.

The form of embodiment illustrated in FIGS. 2*a* to 2*c* can be modified as follows. Instead of providing a position detection by means of the travel sensor 27 and the computer 28 there can be installed a regulating circuit which ascertains each time the position of the elevator car 1 by means of the position sensors 8 and causes, by way of a feedback signal, a displacement of the liquid until a counter-balanced position is achieved. In this case, by detection of the equilibrium position (position of the elevator car 1 with respect to guide rails 4) a setting magnitude for displacement of the diaphragms 23 is produced. The computer unit 29 is not necessary in this form of embodiment.

Figure 3A:
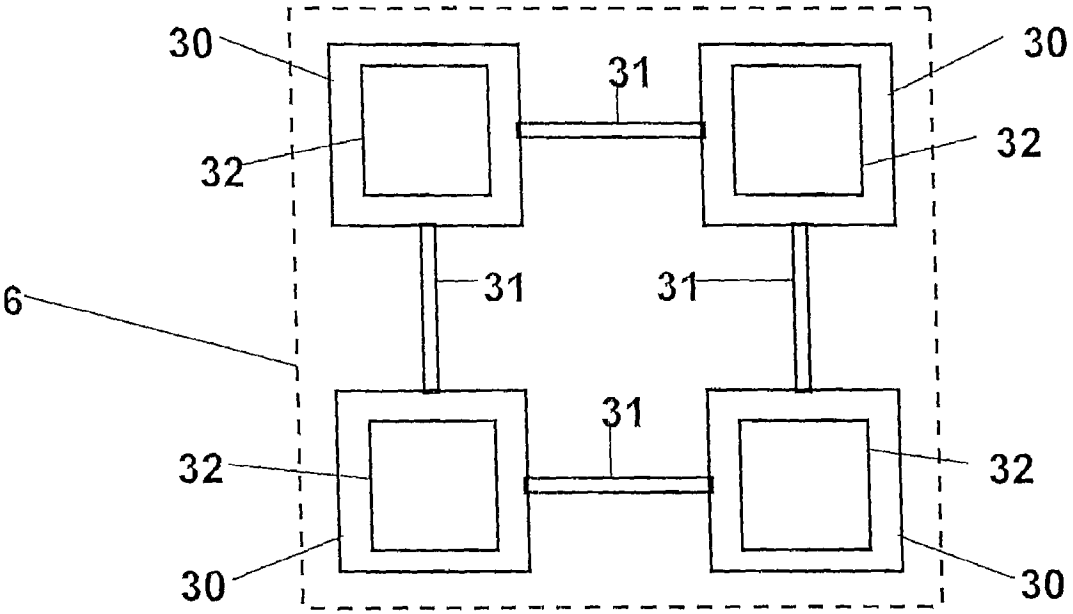
FIGS. 3*a* and 3*b* are schematic top plan view and front elevation in cross section respectively of a hydraulic compensating system according to a second embodiment of the present invention.
Figure 3B:
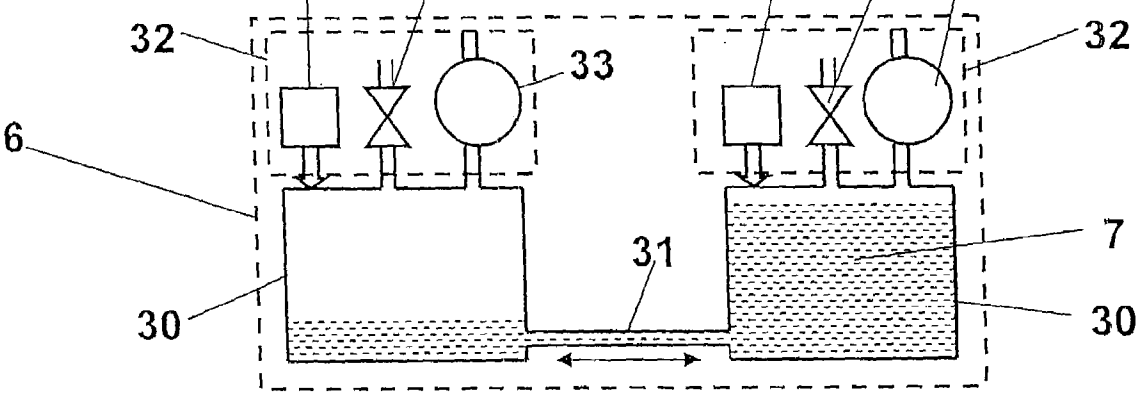

A second form of embodiment according to the present invention is shown in FIGS. 3*a* and 3*b*. In that case a hydraulic compensating system 306 is so designed that the displacement of the liquid 7 can be produced by pressurized air. The compensating system 306 then comprises several containers 30 which contain the liquid 7. The containers 30 are interconnected by connecting ducts 31 in order to thereby enable a controlled displacement of the liquid 7. FIG. 3*a* shows a schematic plan view with four cube-shaped containers 30 as example. In that case, with respect to shape, number, content volume and arrangement of the containers 30 the same considerations with respect to an advantageous realization come into use as explained in the first form of embodiment.

In addition, according to the second form of embodiment the container 30 is connected with a pressurized air system 32. The pressurized air system 32 comprises a pressurized air pump 33 and a pressure compensating valve 34, wherein the air pressure or the liquid level in the container 30 can be measured by a sensor 35. Through appropriate actuation of the pressurized air pumps 33 and the pressure compensating valves 34 a controlled displacement of the liquid 7 for weight compensation of the elevator car 1 can in that case be produced. In the sense of the invention, differently conceived pressurized air systems can also be used.

Figure 3C:
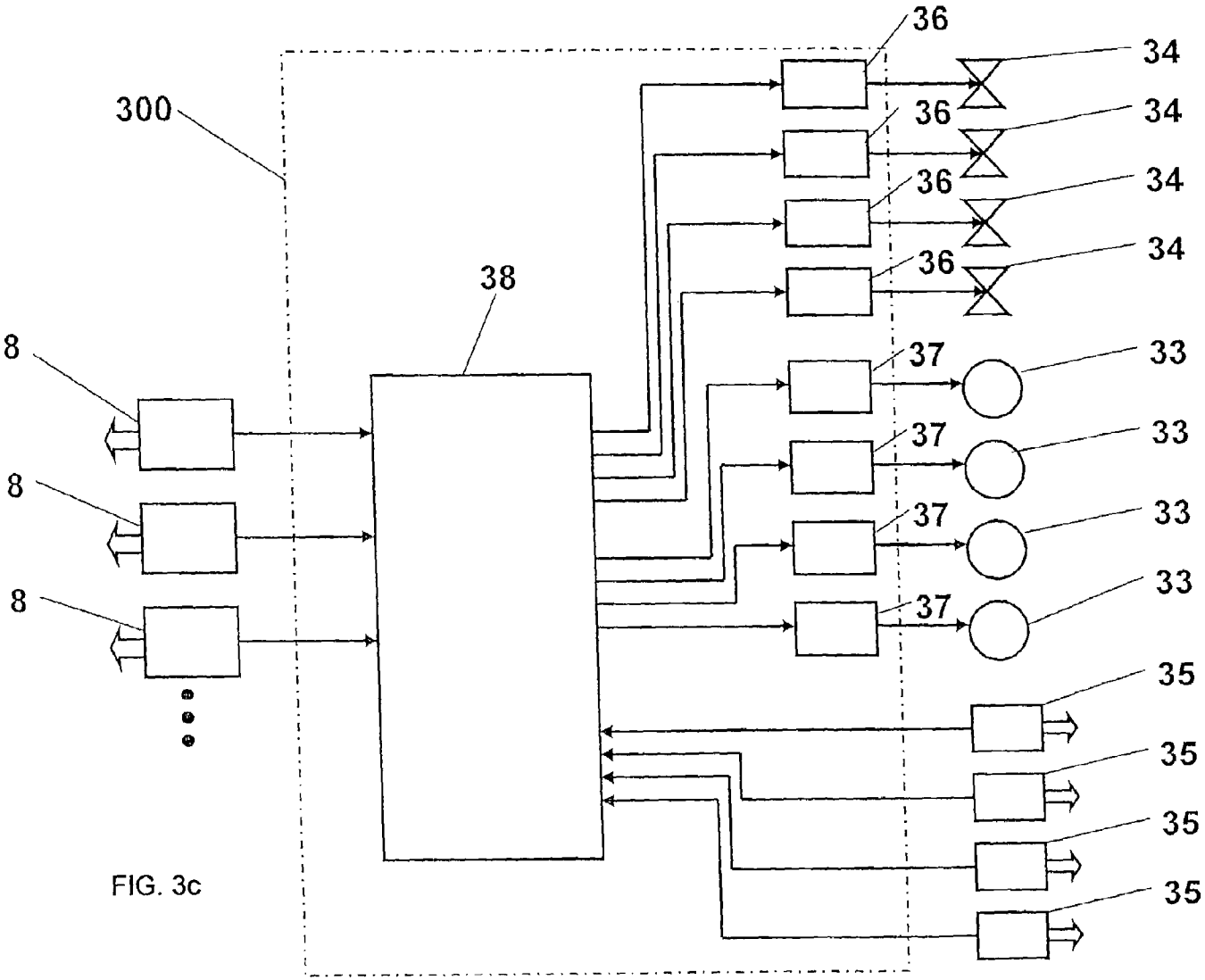
FIG. 3*c* is a schematic illustration of a control unit for control of the hydraulic compensating system shown in FIGS. 3*a* and 3*b* according to the second embodiment of the present invention.

FIG. 3*c* shows a schematic illustration of a control unit 300 for control of the liquid displacement of the hydraulic compensating system 306 according to the second form of embodiment of the invention. The control system 300 comprises a computer unit 38 which is connectable with the position sensors 8. Moreover, the control unit 300 comprises several motor drive units 37 which are connectable with the computer unit 38, wherein the motor drive unit 37 is additionally connectable with the pressurized air pump 33, and several valve drive units 36 which are connectable with the computer unit 38, when the valve drive unit 36 is connectable with the pressure compensating valve 34. The computer unit 38 is additionally connectable with the sensors 35. The control unit 300 is in that case so designed that the position sensors 8 signal to the computer unit 38 the position of the compensating car 1, whereupon the computer unit 38 carries out a computation of the requisite liquid displacement for weight balancing and whereupon as a result the appropriate pressurized air pumps 33 are actuated by way of the motor drive units 37 and the appropriate pressure compensating valves 34 are closed by way of the valve drive units 36. The sensors 35 signal to the computer unit 38 the air pressure or the liquid state in the corresponding vessels 30 and thereby enable determination of the instantaneous status of the liquid displacement. This process can be designed as a regulating circuit, wherein the position sensors 8 deliver a feedback of the instantaneous state of the weight balancing.

The form of embodiment illustrated in FIGS. 3*a* to 3*c* can be modified as follows. Instead of providing a detection by means of the sensors 35 and the computer unit 38 a regulating circuit can be installed which ascertains each time the position of the elevator car 1 by means of the position sensors 8 and causes, by way of a feedback signal, a displacement of the liquid until a counter-balanced position is attained. In this case, through detection of the equilibrium position (position of the elevator car 1 with respect to guide rails 4) a setting magnitude for displacement of the liquid is produced. This form of embodiment can be realized with only one pressurized air pump 33 (for example, in the form of a compressor) and with one pressure container. Instead of providing a respective pressure compensating valve 34 for each container 30 it is sufficient for this form of embodiment to use a single directional valve for each container 30, which either connects the container 30 with the mentioned pressure container or enables a pressure balance relative to the atmosphere. The computer unit 38 is not necessary in this form of embodiment.

Figure 4A:
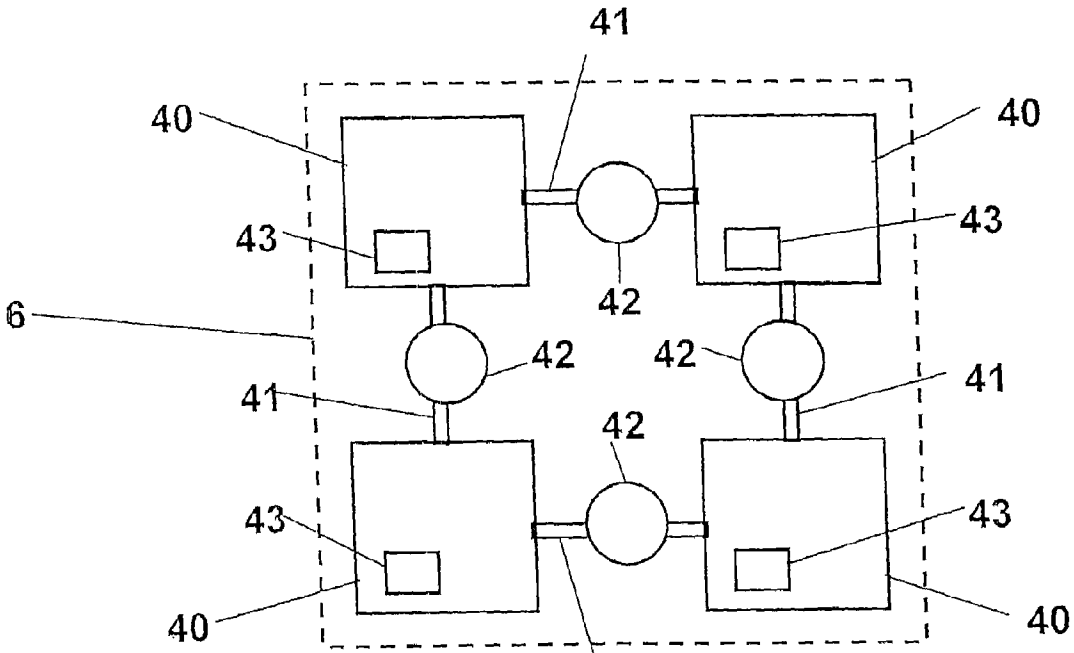
FIGS. 4*a* and 4*b* are schematic top plan view and front elevation in cross section respectively of a hydraulic compensating system according to a third embodiment of the present invention.
Figure 4B:
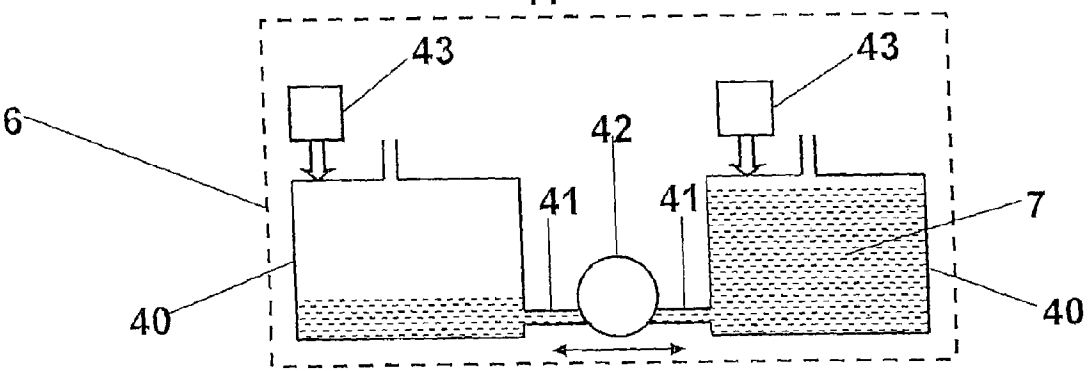

A third form of embodiment according to the present invention is shown in FIGS. 4*a* and 4*b*. In that case a hydraulic compensating system 406 is so designed that a controlled displacement of the liquid 7 can be effected by hydraulic pumping around. The hydraulic compensating system 406 then comprises several containers 40 which are interconnectable by connecting ducts 41 and liquid pumps 42. The container 40 is in that case connected with a level sensor 43 which can measure the liquid state in the container 40. The arrangement of containers 40, the liquid pumps 42 and the connecting ducts 41 shown in FIGS. 4*a* and 4*b* can also be realized by a different arrangement enabling a controlled displacement of the liquid 7 in the sense of the present invention.

Figure 4C:
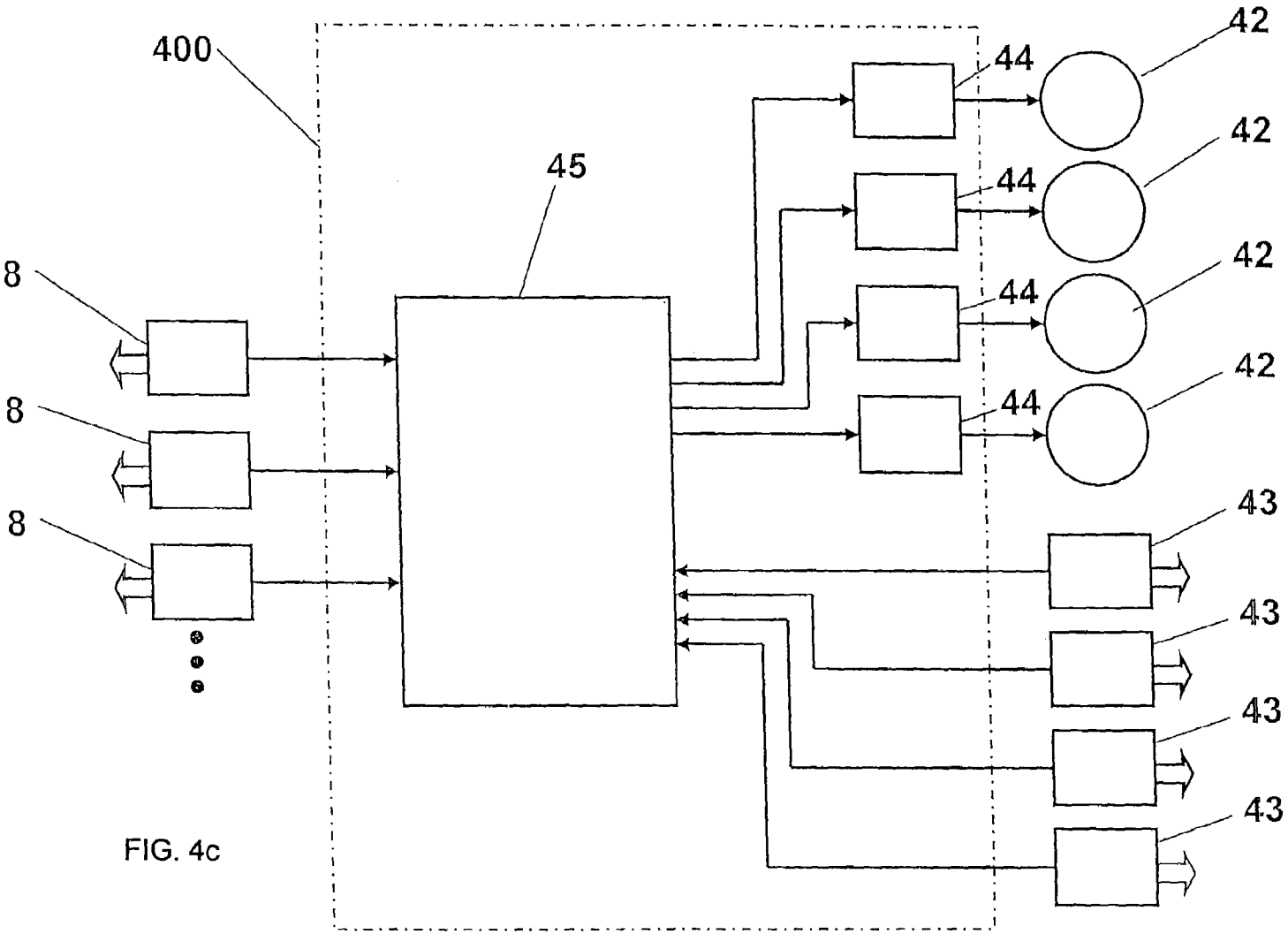
FIG. 4*c* is a schematic illustration of a control unit for control of the hydraulic compensating system shown in FIGS. 4*a* and 4*b* according to the third embodiment of the present invention.

FIG. 4*c* shows a schematic illustration of a control unit 400 for control of the liquid displacement of the hydraulic compensating system 406 according to the third form of embodiment of the present invention. The control system 400 comprises a computer unit 45 which is connectable with the position sensors 8. In addition, the control unit 400 comprises several motor drive units 44 which are connectable with the computer unit 45, wherein the motor drive unit 44 is additionally connectable with the liquid pump 42. The computer unit 45 is further connectable with the level sensors 43. The control unit 400 is in that case so designed that the position sensors signal to the computer unit 45 the position of the compensating car 1, whereupon the computer unit 45 carries out a computation of the requisite liquid displacement for the weight balancing and whereupon as a result the appropriate liquid pumps 42 are actuated by way of the motor drive units 44. The level sensors 43 signal to the computer unit 45 the liquid level or the air pressure in the containers 40 and thereby enable determination of the instantaneous status of the liquid displacement. This process can be designed as a regulating circuit, wherein the position sensors 8 deliver a feedback of the instantaneous state of the weight balancing.

The form of embodiment illustrated in FIGS. 4*a* to 4*c* can be modified as follows. Instead of providing a detection by means of the level sensors 43 and the computer unit 45 there can be installed a regulating circuit which ascertains each time the position of the elevator car 1 by means of position sensors and causes, by way of a feedback signal, a hydraulic pumping around of the liquid until a counter-balanced position is achieved. In this case through detection of the equilibrium position (position of the elevator car 1 with respect to the guide rails 4) a setting magnitude for pumping around the liquid is produced. This form of embodiment can be realized without the level sensors 43 and without the computer unit 45.

Figures 5A, 5B, 5C:
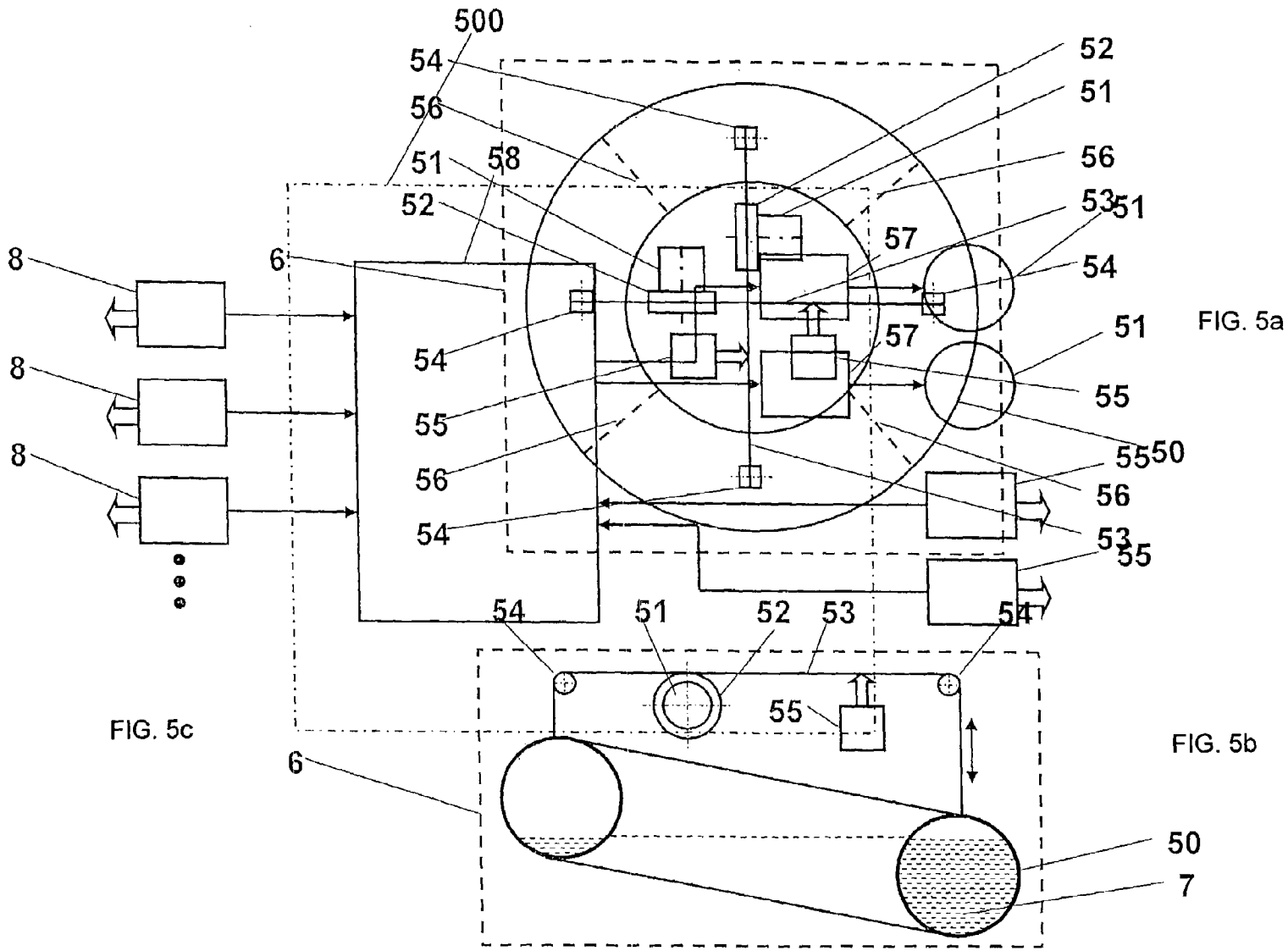
FIGS. 5*a* and 5*b* are schematic top plan view and front elevation in cross section respectively of a hydraulic compensating system according to a fourth embodiment of the present invention.
FIG. 5*c* is a schematic illustration of a control unit for control of the hydraulic compensating system shown in FIGS. 5*a* and 5*b* according to the fourth embodiment of the present invention.
Figure 5C:
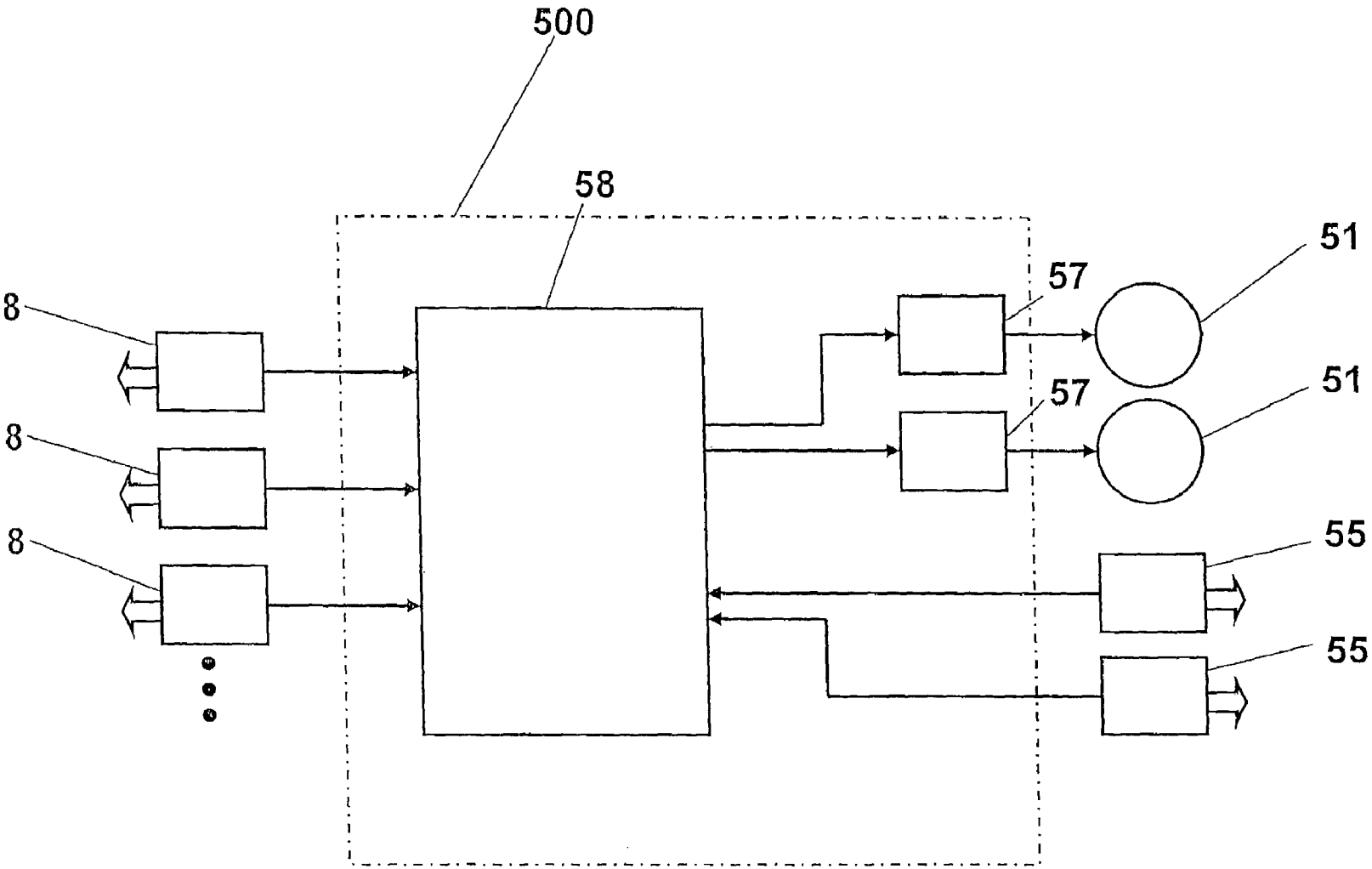

A fourth form of embodiment according to the invention is shown in FIGS. 5*a* and 5*b*. In that case a hydraulic compensating system 506 is so designed that for weight compensation a controlled displacement of the liquid 7 can be produced by tilting of a toroidal container 50. The container 50 in that case comprises several surge plates 56 which damp a hunting of the liquid 7 during the tilting process or during travel of the elevator car 1. The surge plates 56 can be executed as, for example, apertured plates which can be fastened in the interior of the container 50. The container 50 can be tilted in two planes, wherein the inclination in one plane can be caused by a cable pull 53 guided over deflecting rollers 54. The cable pull 53, can in that case be moved by a cable drum 52 which is connectable with a motor 51. A cable travel sensor 55, which can detect the movement of the cable pull 53, can in that case serve for determining the inclination. An example of the embodiment with the toroidal container 50 is schematically shown in FIGS. 5*a* and 5*b*. The container 50 can, in the sense of the invention, also have another suitable shape in order to be able to displace the liquid 7 as asymmetrically as possible, from which a further range for compensation of the eccentric loading 2 results. As a further variation of the fourth form of embodiment of the invention also several containers 50, which are interconnectable by flexible connecting ducts, can be used. In that case the liquid displacement can be produced by appropriate vertical lowering or raising of the container 50, for example by way of cable pulls and setting motors.

FIG. 5*c* shows a schematic illustration of a control unit 500 for the control of the liquid displacement of the hydraulic compensating system 506 according to the fourth form of embodiment of the invention. The control system 500 comprises a computer unit 58 which is connectable with the position sensors 8. In addition, the control unit 500 comprises several motor drive units 57 which are connectable with the computer unit 58, wherein the motor drive unit 57 is further connectable with a motor 51. The computer unit 58 is additionally connectable with the cable travel sensors 55. The control unit 500 is then so designed that the position sensors 8 signal to the computer unit 58 the position of the compensating car 1, whereupon the computer unit 58 carries out a calculation of the requisite liquid displacement for weight balancing and whereupon as a result the appropriate motors 51 are actuated by way of the motor drive units 57. The cable travel sensors 55 signal to the computer unit 58 the inclination of the container 50 in the two planes and thereby enable determination of the instantaneous status of the liquid displacement. This process can be designed as a regulating circuit, wherein the position sensors 8 deliver a feedback of the instantaneous state of the weight balancing.

The form of embodiment illustrated in FIGS. 5*a* to 5*c* can be modified as follows. Instead of providing detection by means of the cable travel sensors 55 and the computer unit 58 there can be installed a regulating circuit which ascertains each time the position of the elevator car 1 by means of the position sensors 8 and causes, by way of a feedback signal, tilting of the container 50 and thus displacement of the liquid 7 until a counter-balanced position is achieved. In this case, through detection of the equilibrium position (position of the elevator car 1 with respect to guide rails 4) a setting magnitude for tilting of the container 50 is produced. This form of embodiment can be realized without the cable travel sensors 55 and without the computer unit 58.

The forms of embodiment shown in FIGS. 1*a* through 5*c* can be simplified in that less than four containers can be used. An economic form of embodiment with two containers can be realized, of which one is disposed in the region below the car door and one in the region below the rear car wall. This form of embodiment takes into account the fact that loading states frequently arise in which an overloading occurs in the region of the rear car wall. Through displacement of the liquid from the rear container into the container arranged in the region below the car door, compensation for such a loading state can be provided.

An elevator installation according to the present invention can be designed to be particularly reliable and comfortable if an elevator car with integrated weight compensation is used, as described in conjunction with FIGS. 1*a* to 5*c*.

The present invention is particularly suitable for use in a high-performance elevator which covers greater height differences at high speed. It is of significance particularly in the case of high-performance elevators that the smallest unevennesses in the guide rails are picked up by the sprung rollers, whilst the springs operate in the soft range of the spring characteristic.

A further form of embodiment of the present invention is distinguished by the fact that an optical sensor is mounted at the elevator car 1 and comprises a transmitter and a receiver. The transmitter transmits light which is reflected by reflectors disposed at the elevator shaft 9 in the region of each floor. The reflected light is received by the receiver and a statement with respect to the eccentric loading of the elevator car 1 is obtained from the position of the received light.

The computer units (29, 38, 45, 58) can be realized as, for example, "Application Specific Integrated Circuits" (ASIC) or as a microcomputer and preferably embrace all necessary functions in order to be able to carry out control of the hydraulic compensating systems (6, 306, 406, 506).

Figure 6:
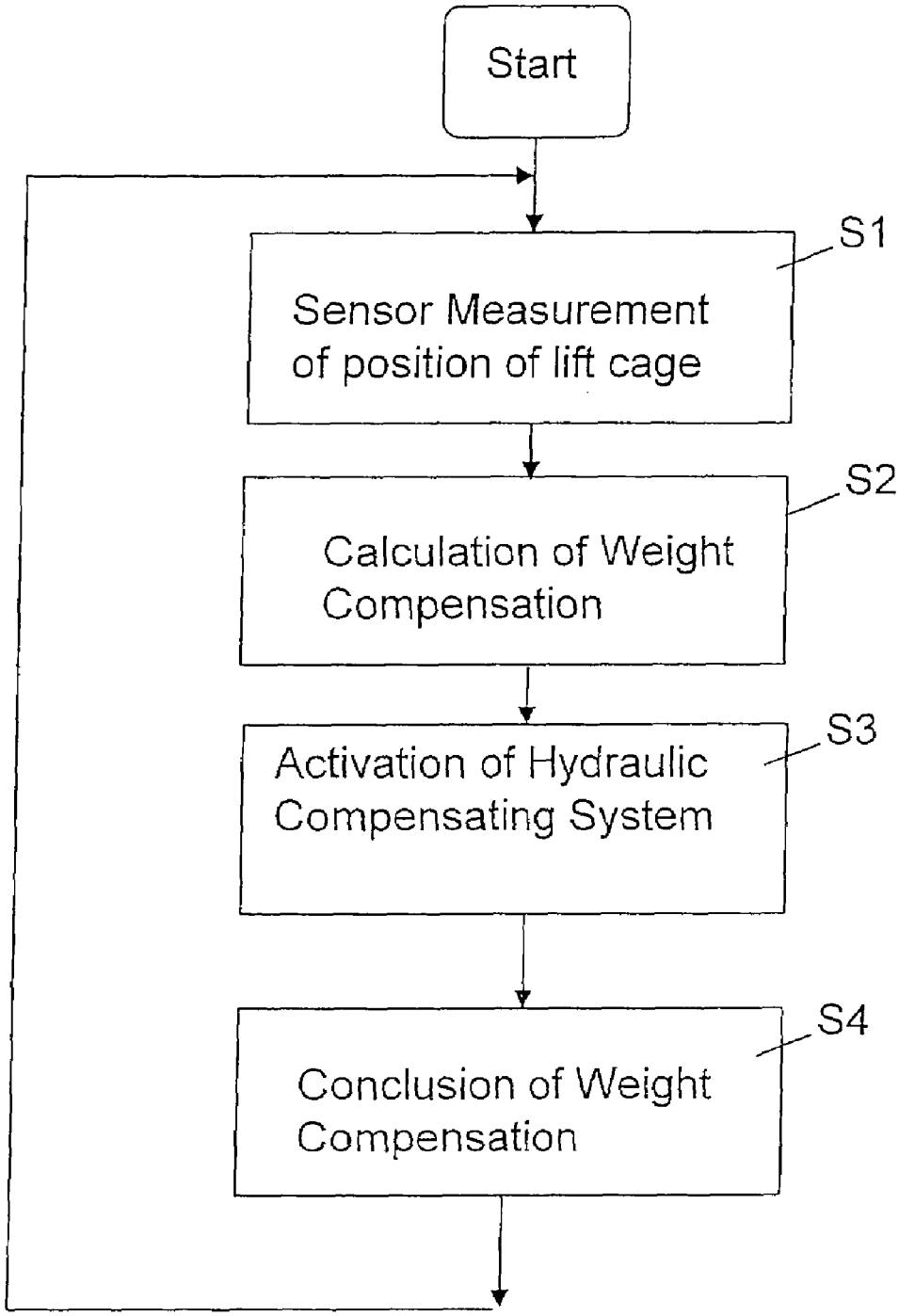
FIG. 6 is a flow chart of a method according to the present invention for weight compensation of the elevator car.

In addition, a method according to FIG. 6 is described for weight compensation of the elevator car 1 with the eccentric loading 2 by means of the hydraulic compensating system (6, 306, 406, 506), the sensor system 5 and the control unit (200, 300, 400, 500), wherein the method comprises the following steps:

A) determining the position of the elevator car 1 by the sensor system 5 (step S1);

B) calculating a necessary liquid displacement by means of the control unit 200, 300, 400 or 500 (step S2);

C) actuating the hydraulic compensating system 6, 306, 406 or 506 by means of the control unit 200, 300, 400 or 500 for carrying out the weight compensation (step S3);

D) monitoring the weight compensation by means of the sensor system 5 (this step is optional); and E) concluding the weight compensation (step S4).

The individual method steps were in part already explained in detailed form above in conjunction with the exemplifying forms of embodiment one to four according to the present invention. FIG. 6 schematically shows a flow chart of the method for weight compensation.

It is in that case of advantage if the system according to the present invention is so designed that the time for carrying out the weight compensation amounts to no more than three to five seconds. In a further advantageous form of embodiment of the present invention the described method can be enlarged in that the setting of the elevator car door (open or closed), the state of the elevator car (stationary, slow travel, fast travel) and/or other information is utilized for activation or deactivation of the weight compensation.

The weight compensation of the elevator car 1 can, according to the present invention, be possible with an empty or a loaded elevator car. The advantage thereby results of being able to dynamically undertake counterbalancing of the empty elevator car 1.

The weight compensation of the elevator car 1 according to the method can also be activated only ahead of a fast journey. The advantage thereby results that the time needed for weight compensation can be saved or that the system can be designed to be energy-saving.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator car for vertical movement in an elevator shaft which has vertically arranged guide rails, wherein the elevator car has guiding means for guiding the elevator car along the guide rails, comprising:

an elevator car adapted to carry a load; and a hydraulic compensating system attached to said elevator ear for displacing a quantity of a liquid relative to a point of suspension of said elevator car in response to an eccentric loading of said elevator car thereby generating a torque compensating for the eccentric loading.

2. The elevator car according to claim 1 wherein said compensating system includes a sensor system for detecting the eccentric loading.

3. The elevator car according to claim 2 wherein said sensor system includes at least two position sensors for establishing a position of said elevator car with respect to the guide rails.

4. The elevator car according to claim 3 wherein the guiding means includes spring mounted rollers and said position sensors establish the position of said elevator car by measuring a spring travel of the spring-mounted rollers on said elevator car.

5. The elevator car according to claim 3 wherein said position sensors establish the position of said elevator car by a mechanical contact or a mechanical non-contact with the guide rails.

6. The elevator car according to claim 1 wherein said compensating system mechanically displaces said liquid.

7. The elevator car according to claim 1 including a control unit, wherein said compensating system includes at least two containers containing said liquid and interconnected by at least one connecting duct and a displacement system connected with said at least two containers, said control unit being connected to said displacement system for controlling the movement of said liquid between said at least two containers through said at least one connecting duct.

8. The elevator car according to claim 7 wherein said displacement system includes for each of said at least two containers a movable plunger attached to a flexible diaphragm, a spindle attached to said plunger and a setting motor connected to said spindle, said control unit being connected to said setting motors for moving said plungers.

9. The elevator car according to claim 1 including a control unit, wherein said compensating system includes at least two containers containing said liquid and interconnected by at least one connecting duct and a pressurized air system connected to said containers, said control unit being connected to said pressurized air system for controlling the movement of said liquid between said at least two containers through said at least one connecting duct.

10. The elevator car according to claim 9 wherein said pressurized air system includes a pressurized air pump and a valve connected to said at least two containers for supplying pressurized air to said at least two containers.

11. The elevator car according to claim 1 including a control unit, wherein said compensating system includes at least two containers containing said liquid and interconnected by at least one connecting duct and at least one liquid pump connected to said at least two containers, said control unit being connected to said at least one pump for controlling the movement of said liquid between said at least two containers through said at least one connecting duct.

12. The elevator car according to claim 1 including a control unit, wherein said compensating system includes a toroidal container containing said liquid and a plurality of surge plates, said container being tiltable under control by said control unit.

13. The elevator car according to claim 12 including at least one cable pull guided over deflecting rollers and attached to said container, a motor and a cable drum connected to said at least one cable pull, said control unit being connected to said motor for controlling the movement of said liquid in said container.

14. A method of weight compensation of an elevator car in case of eccentric loading comprising the steps of:

a) detecting eccentric loading of the elevator car by determining a position of the elevator car relative to guide rails with a sensor system;

b) actuating a hydraulic compensating system attached to the elevator car to provide weight compensation in response to the detected eccentric loading; and c) monitoring the weight compensation with the sensor system.

15. The method according to claim 14 including a step of calculating a required liquid displacement in a control unit before or during performing said step b).

16. A weight compensation system for an elevator car that moves vertically in an elevator shaft, the elevator car having spring-mounted rollers for guiding the elevator car along guide rails in the elevator shaft, comprising:

a hydraulic compensating system adapted to be attached to the elevator car and having a quantity of a liquid displaceable in response to an eccentric loading of the elevator car;

a sensor system adapted to be attached to the elevator car for determining a position of the elevator car relative to the guide rails; and a control unit connected to said sensor system and to said compensating system whereby when said sensor system and said compensating system are attached to the elevator car, said control unit responds to a position determined by said sensor system representing an eccentric loading of the elevator car by controlling displacement of said liquid in said compensating system to compensate for the eccentric loading.

17. The weight compensation system according to claim 16 wherein said compensating system includes at least two containers containing said liquid and interconnected by at least one connecting duct and a displacement system connected with said at least two containers, said control unit being connected to said displacement system for controlling the movement of said liquid between said at least two containers through said at least one connecting duct.

18. The weight compensation system according to claim 16 wherein said compensating system includes at least two containers containing said liquid and interconnected by at least one connecting duct and a pressurized air system connected to said containers, said control unit being connected to said pressurized air system for controlling the movement of said liquid between said at least two containers through said at least one connecting duct.

19. The weight compensation system according to claim 16 wherein said compensating system includes at least two containers containing said liquid and interconnected by at least one connecting duct and at least one liquid pump connected to said at least two containers, said control unit being connected to said at least one pump for controlling the movement of said liquid between said at least two containers though said at least one connecting duct.

20. The weight compensation system according to claim 16 wherein said compensating system includes a toroidal container containing said liquid and a plurality of surge plates, said container being tillable under control by said control unit.

* * * * *